United States Patent [19]

McCrory

[11] Patent Number: 4,916,672

[45] Date of Patent: Apr. 10, 1990

[54] MIXING AND BLENDING SHAKER APPARATUS AND METHOD

[76] Inventor: Carl E. McCrory, 14901 E. Hornell St., Whittier, Calif. 90604

[21] Appl. No.: 237,137

[22] Filed: Aug. 29, 1988

[51] Int. Cl.[4] ..... B01F 11/00

[52] U.S. Cl. ..... 366/130; 366/242

[58] Field of Search ..... 366/129, 130, 342, 343, 366/227, 228, 242, 229; 68/213; 134/117

[56] References Cited

U.S. PATENT DOCUMENTS

| | | | |
|---|---|---|---|
| 567,684 | 9/1896 | Moody | 366/342 |
| 2,021,011 | 11/1935 | Lande | 366/130 |
| 2,610,432 | 9/1952 | Ambrose | 366/130 |
| 2,734,468 | 2/1956 | Jones | 366/130 |
| 4,480,926 | 11/1984 | Lattery | 366/130 |
| 4,735,510 | 4/1988 | Barbour | 366/343 |

*Primary Examiner*—Robert W. Jenkins

*Attorney, Agent, or Firm*—Paul R. Wylie

[57] ABSTRACT

There is provided a mixing and blending shaker apparatus having a wire whip attached to the cover of a plastic container and positioned such that when the cover is screwed onto the container, the whip becomes supported centrally inside the container to serve as a mixing baffle for improving and facilitating mixing and blending of various fluids and/or powdered materials, such as soft serve ice cream and yogurt type products.

7 Claims, 1 Drawing Sheet

MIXING AND BLENDING SHAKER APPARATUS AND METHOD

GENERAL NATURE OF THE INVENTION

This invention relates to improved apparatus and methods for mixing and blending particularly directed to the shake-mixing of fluids together with powdered substances as well as the blending of various viscous ingredients. The invention is particularly related to but not restricted to processing foodstuffs as exemplified by the preparation of powdered soft serve ice cream and yogurt type products.

BACKGROUND OF THE INVENTION

Improvements in mixing and blending apparatus for mixing powdered materials in fluids have been disclosed in U.S. Pat. No. 4,747,696 to McCrory et al, directed to improvements in motor-driven axial-impeller type mixers for many different types of products, and teaching the addition of mixing baffle means in mixing containers so as to induce turbulence and thus break up laminar fluid flow and thereby provide enhanced mixing efficiency.

The present invention addresses an alternative apparatus and method for mixing and blending materials such as powdered soft serve ice cream and yogurt products, and the like.

A well known manual mixing device comprises a handle attached to a whip device formed from multiple loops of spring wire, utilized for general mixing purposes, typically in mixing and blending food materials such as eggs and batter in preparation for cooking. In the principal mode of utilizing the whip device, predetermined amounts of various ingredients are placed into an open bowl, and then, while holding the bowl steady, the whip device is manually agitated in generally circular motions through the ingredients until they are sufficiently blended.

This method has generally sufficed for domestic purposes; however in commercial food-handling environments, there are a number of inherent disadvantages:

Special skill and care are required to mix adequately in reasonable time: effort to accelerate the mixing by more vigorous activity tend to cause unacceptable spillage.

Mixing efficiency dictates that the bowl should be shaped with a large open rim, and the bottom needs to be rounded to avoid corners inaccessible to the rounded end of the wire whip: bowls of this shape are wasteful of storage and refrigeration space.

Also, sanitation is of concern on several counts: due to the large area of food stuffs exposed by the open shape of the bowl, extraneous matter such as dust particles or bacteria suspended in the atmosphere may settle or be drawn into the mixture during the mixing process; the open shape of the bowl makes it difficult to cover and seal; and the wire whip device, which requires frequent cleaning when used in this manner with an open bowl, is inherently difficult to keep clean.

The fast food industry has generally used 3–5 gallon buckets for mixing. These are flat bottomed, not rounded, and have been used successfully without mixing problems. The main sanitation concern the industry has had is the employees misusing these large buckets for jobs other than mixing the product, e.g., inappropriate use of the bucket for washing windows for floors.

During storage or refrigeration, some separation of the mixed ingredients is likely to occur, thus it may be desired to remix the materials from time to time or at least prior to final dispensing. The bowl then needs to be uncovered and unsealed on each remixing occasion and the wire whip requires repeated cleaning.

It is common practice to mix/blend various mixtures of fluids and/or solid ingredients by shaking them in a closed container, either manually or with a shaking machine. In manual mixing, as commonly practiced in the preparation of powdered soft serve ice cream and yogurt products, this basic shaking technique is not always fully effective as it may be difficult and time-consuming to achieve the degree of total contact between powdered phase ingredients and the liquid necessary for a totally blended product. Viscal fluids may resist total mixture by tending to flow mainly in laminar patterns when mixed in ordinary containers lacking baffles to induce turbulence.

The mixing and blending device and techniques of this invention has overcome these and other disadvantages of known shaker-type mixing devices and methods by providing a wire whip securely attached to a screw-on container cover so as to dispose the whip centrally within a container when the cover is threaded onto the container.

In the practice of this invention, the container is charged with fluid and other ingredients and the cover securely closed, and the container is shaken in a manner to force the ingredients past the wire loops of the whip which acts as a baffle, inducing the needed turbulence to break up laminar flow thus accelerate mixing and blending of the ingredients. When the product has been mixed, it may then be stored or refrigerated without removing the cover, keeping the whip inside and thus eliminating the need for cleaning and separate storage of the whip. Then at a later time when the mixture is about to be dispensed, it is simple and convenient to perform an additional shaking at that time to correct any settling that may have taken place, and thus ensure adequate mixing. Once the final product has been mixed it is not necessary to keep the whip in the product. If separation occur during storage the product can be remixed by simply shaking it in the same container with a plain lid.

After use, the cover/whip assembly may be easily cleaned along with the container: the shaking technique may be employed to advantage as part of the cleaning process.

It was an object of this invention to provide in a shaker-type mixer and blender having a enclosed container, the improvement comprising baffle means disposed centrally within the container, for mixing powdered substances in fluids and for mixing other food stuffs.

It was a further object of this invention to provide an improved internally-baffled manual mixer utilizing a conventional plastic jar container to economically and efficiently mix various materials and to facilitate storage and refrigeration.

A further object of this invention was to provide an improved mixing shaker device combining a known plastic jar having a screw-on cover and a wire whip firmly attached to the cover so as to dispose the wire whip centrally within the jar when the cover is threadedly attached, such that the whip is enabled to function as a baffle to enhance the mixing action.

These and other objects of the invention were satisfied by the novel mixer and blender improvements and method of operation of this invention as described herein.

DESCRIPTION OF THE DRAWINGS

The invention will be more fully understood and described in connection with the drawings in which.

DETAILED DESCRIPTION OF THE INVENTION

Figure 1:
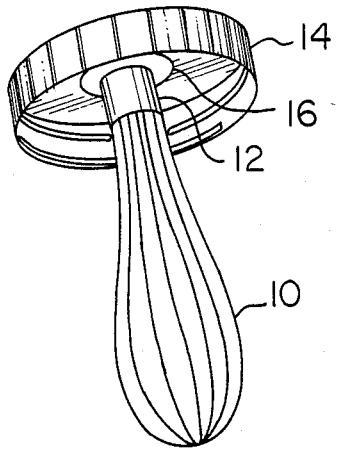
FIG. 1 is a perspective view of a wire whip attached to a jar cover in accordance with this invention.

As shown in the perspective view of FIG. 1, a whip 10, formed from multiple loops of spring wire gathered in a ferrule, 12 is attached centrally to a round internally threaded jar cover 14, with a washer 16 acting as a bearing plate between ferrule 12 and cover 14.

Figure 2:
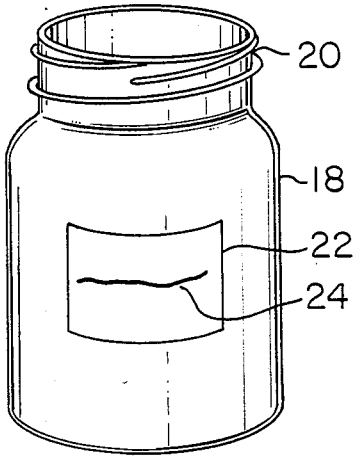
FIG. 2 is a perspective view of a jar intended to mate with the cover shown in FIG. 1.

FIG. 2 shows a known plastic jar 18 having an externally threaded round opening collar 20 intended to mate with cover 14 of FIG. 1. A label 22, which can be either pasted on or silk screened on the jar displays a fluid level indicator line 24 along with operating instructions.

Figure 3:
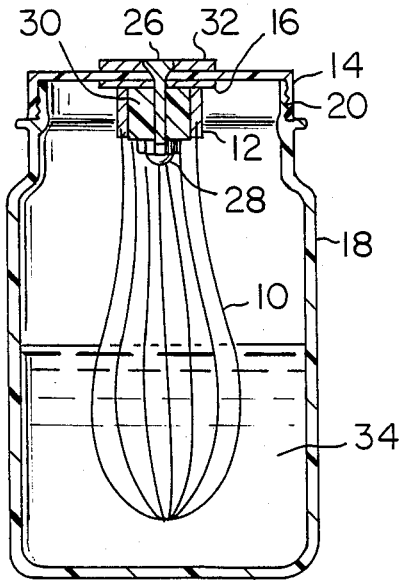
FIG. 3 is a cross section of an improved shaker type mixer/blender formed from the jar of FIG. 2 mated with the cover of FIG. 1, positioning the wire whip of FIG. 1 centrally within the jar in accordance with this invention.

FIG. 3 is cross-section of a mixing apparatus in accordance with this invention in its preferred embodiment wherein cover 14, when threadedly engaged with collar 20 of jar 18, positions the wire whip 10 centrally within the jar 18 as shown. Machine bolt 26 secured by nut 28 against filler material 30 of ferrule 12 holds cover 14 securely sandwidged between washers 16 and 32 which act as pressure plates to provide adequate strength to avoid breakage of cover 14 which may be made from plastic. Jar 18 is shown about half filled with fluid 34.

In the practice of this invention, a fluid ingredient such as milk or water 34 is added to the open jar 18 to the level indicated by marking 24 on label 22 as shown in FIG. 2, and a designated amount of powdered ingredient such as ice cream or yogurt powder is added. Then the cover 14 is threadedly tightened onto collar 20 of jar 18 as seen in FIG. 3 to seal the mixture inside. The entire device is then shaken well for 30 seconds in motions which tend to impel the mixture past the wire loops of whip 10. Then the cover 14 is removed, additional fluid is added to nearly fill the jar 18, the cover 14 is replaced, and the device is shaken again as above, whereupon it is ready to be dispensed or refrigerated.

During shaking, whip 10 acts as a baffle to introduce turbulence and break up laminar flow in the fluid mixture, thus intensifying intimate contact between the fluid and powdered ingredients.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is claimed:

1. A mixing shaker apparatus for blending fluids with other ingredients such as powdered food substances, comprising:
   (a) a mixing container having an upper opening;
   (b) a cover adapted to removably engage said container by fastening means in a manner to provide a sealed enclosure with said container; and
   (c) a wire whip mixing baffle formed from multiple loops of spring wire gathered in a ferrule attached centrally to said cover by attachment means in a manner to securely position said wire whip centrally within said container whenever said cover is engaged with said container by said fastening means, whereby when said container is loaded with the fluids and other ingredients, engaged with said cover, and shaken in a manner to intermix said fluids and other ingredients, said wire whip mixing baffle is enabled to interact with said fluids and other ingredients in a manner to expedite and enhance mixing and blending thereof.

2. The mixing shaker apparatus as defined in claim 1 wherein said container is made from plastic and is provided with an upper opening surrounded by a circular collar, said cover is made circular and provided with a downward circumferential rim, and said fastening means comprise external screw threads on said collar mating with internal screw threads in said cover rim.

3. The mixing shaker apparatus as defined in claim 1 wherein said wire whip mixing baffle is formed from a plurality of stainless steel spring wire loops gathered at one end into a ferrule part which is attached to said cover by baffle attachment means.

4. The mixing shaker apparatus as defined in claim 3 where said baffle attachment means comprise a machine bolt inserted through a first reinforcement washer disposed on an upward facing surface of said cover, through an opening in said cover, through a second reinforcement washer disposed on a downward facing surface of said cover, through an opening in said ferrule part, and retained by a machine nut disposed on a downward facing surface of said ferrule part.

5. The invention as defined in claim 1 wherein said container comprises a plastic jar, said cover being adapted to threadedly attach thereon, and wherein said wire whip mixing baffle is attached to said cover by a nut-retained machine bolt.

6. An improved method of mixing fluids and other ingredients such as powdered substances together in a covered container, comprising the steps of:
   (1) providing a container having a sealing-type cover to which is attached a wire whip mixing baffle formed from multiple loops of spring wire gathered in a ferrule so disposed as to occupy a central position within the container when the cover is attached hereto,
   (2) adding a designated amount of fluid and other ingredients into the container,
   (3) attaching the cover to the container, and
   (4) shaking the container in a manner to impel the contents past and through the wire whip mixing baffle, thereby creating turbulence and thus accelerating intimate contact between the fluid and other ingredients so as to accomplish improved mixing and blending.

7. The improved mixing method as defined in claim 6 wherein the container is filled only to about one half capacity in step (2), and wherein the method comprises the further steps of:

(5) removing the cover,
(6) adding more fluid until the container becomes nearly full,
(7) again attaching a cover to the container, and
(8) again shaking the container in a manner to impel the contents past and through the wire whip baffle, thereby creating turbulence and thus accelerating intimate contact between the fluid and other ingredients so as to accomplish improved mixing and blending.

* * * * *